US005839917A

United States Patent [19]

Takahashi et al.

[11] Patent Number: 5,839,917

[45] Date of Patent: Nov. 24, 1998

[54] CONNECTOR FOR FLAT CABLE

[75] Inventors: Wataru Takahashi, Tokyo; Kenichi Hatakeyama, Iwate, both of Japan

[73] Assignee: NEC Corporation, Tokyo, Japan

[21] Appl. No.: 714,299

[22] Filed: Sep. 18, 1996

[30] Foreign Application Priority Data

Sep. 18, 1995 [JP] Japan ..... 7-238881

[51] Int. Cl.[6] ..... H01R 23/66

[52] U.S. Cl. ..... 439/495; 439/67

[58] Field of Search ..... 439/495, 492, 439/493, 499, 494, 326, 329, 260, 67, 77

[56] References Cited

U.S. PATENT DOCUMENTS

| | | | |
|---|---|---|---|
| 4,944,690 | 7/1990 | Imai | 439/495 |
| 5,013,255 | 5/1991 | Juret et al. | 439/260 |
| 5,106,311 | 4/1992 | Yodogawa et al. | 439/495 |
| 5,425,651 | 6/1995 | Thrush et al. | 439/326 |
| 5,525,071 | 6/1996 | Obara et al. | 439/326 |

*Primary Examiner*—P. Austin Bradley
*Assistant Examiner*—Tho D. Ta
*Attorney, Agent, or Firm*—Young & Thompson

[57] ABSTRACT

A connector for a flat cable comprises a housing including a rectangular-shaped base portion defined by opposite first and second sides and opposite third and fourth sides and first and second side walls provided on the third and fourth sides. A plurality of first contacts each has a first contact convex and a first lead terminal. First contacts laterally extend from the first side toward the second side. First lead terminals project outward from the first side. First contact convex portions face upward and are provided at inner and top end portions of the first contacts. A plurality of second contacts are provided, each of which has a second contact convex and a second lead terminal. Second contacts laterally extend from the second side toward the first side. Second lead terminals project outward from the second side. Second contact convex portions face upward and are provided at inner and top end portions of the second contacts. Second contacts are discontinuously aligned at a second pitch. Each of the second contact convex portions are positioned between adjacent two of the first contact convex portions so that the first and second contact convex portions alternate with each other. A lever is further pivotally attached to the side walls of the housing. The lever has an engaging portion which is spaced over the first and second contact convex portions for sandwiching a flat cable between the engaging portion and the first and second contact convex portions.

9 Claims, 5 Drawing Sheets

CONNECTOR FOR FLAT CABLE

BACKGROUND OF THE INVENTION

The present invention relates to a connector for a flat cable, and more particularly to a compact connector for a flat cable, which is suitable for a high density packaging on a printed circuit board.

High density packaging and scaling down of electronic elements on a printed circuit board have been required, whereby the connector for a flat cable has also been required to be adjusted for the high density packaging and its substantial scaling down. Typical connectors for the flat cable are disclosed in the Japanese laid-open patent publications Nos. 6-77186 and 5-84071.

FIG. 1 is a cross sectional elevation view illustrative of a conventional connector for a flat cable, which is disclosed in the Japanese laid-open patent publication No. 6-77186. A connector 1 comprises a housing 2 which is box-shaped but opened at opposite sides, and a contact member 6 mechanically engaged with the housing 2 as well as a lever also engaged with the housing 2 for holding a flat cable 4 in cooperation with the lever 5. The contact member 6 is inserted via a first opening side of the housing 2 into the interior of the housing 2. The contact member 6 comprises a body 6*d* vertically extending, a supporting head 6*a* laterally extending from an upper portion of the body 6*d* toward the interior of the housing 2, a U-shaped spring portion 6*b* largely and laterally extending from a lower portion of the body 6*d* toward the interior of the housing 2 and a lead terminal portion 6*c* provided at the lower portion of the body 6*d* but in the opposite side to the U-shaped spring portion. The supporting head 6*a* extends under an inner surface of the top wall of the housing 2. The supporting head 6*a* has a top which is cyrindrically shaped and fitted with a cyrindrically shaped recess formed at a lower portion of the lever so as to allow a pivotal motion of the lever around the cyrindrically shaped top of the supporting head 6*a* for securing the flat cable 4 in cooperation with the U-shaped spring portion 6*b* of the contact member 6. The U-shaped spring portion 6*b* comprises lower portion extending over an inner surface of the bottom wall of the box-shaped housing 2 and an upper portion connected via a curved portion to the lower portion and positioned over the lower portion thereof. The top of the upper portion of the U-shaped spring portion 6*b* has a convex portion which may be in contact with the bottom surface of the flat cable 4. The lever 5 has a holding head portion 5*a*. When the lever 5 stands vertically, the holding head portion 5*a* of the lever 5 fits the top surface of the flat cable 4 so that the flat cable 4 is sandwiched between the holding head portion 5*a* of the lever 5 and the convex provided on the top of the upper portion of the U-shaped spring portion 6*b*.

In order to realize the high density packaging and the substantial scaling down of the connector, it is required to make the pitch between the adjacent contact members 6 narrow, whilst the adjacent contact members 6 are required to be spaced for isolation between them. This limitation to the pitch between the contact members 6 prevents the scaling down of the connector.

Further, in order to realize the high density packaging and the substantial scaling down of the connector, it is required to limit the height of the connector 1. This requires a limitation in thickness of the supporting head 6*a* even the supporting head 6*a* receives a stress by pivotal motion of the lever 5. Namely, if the substantial scaling down of the connector takes place, this makes it difficult for the supporting head 6*a* of the contact member 6 to have a sufficient thickness for supporting the pivotal motion of the lever 5. For this reason, the supporting head 6*a* of the contact member 6 is required to support the levers in cooperation with a part of the top wall of the housing 2. The walls of the housing 2 are made of a plastic material for electrical isolation. In the light of a possible reduction in height of the connector 1, it is difficult to have the top wall of the housing 2 with a sufficient thickness for supporting the pivotal motion of the lever 5 in cooperation with the supporting head 6*a* of the contact member 6. The frequent pivotal motions of the lever 5 may cause creeps which lead to permanent deformations of the plastic housing 2 and the supporting head 6*a* of the contact member 6. As a result, a stress appears on the lead terminal portion 6*c* of the contact member 6 thereby causing cracking the lead terminal portion 6*c* which has to be soldered with pads of the printed circuit board. This makes it difficult to ensure a stable connection between the connector and the printed circuit board.

Another conventional connector is disclosed in the Japanese laid-open patent publication No. 5-84071. FIG. 2 is a decomposed cross sectional view illustrative of the conventional connector. FIG. 3 is a plane view illustrative of the conventional connector. FIG. 4 is a cross sectional view illustrative of the conventional connector. The connector 8 comprises a box-shaped mold 11, and first and second contact members 9 and 12. The box-shaped mold 11 has opposite open sides through which the first and second contact members 9 and 12 are inserted into the interior of the box-shaped mold 11. A flat cable 10 is inserted into the box-shaped mold 11 from the same side as the second contact member 12 is inserted thereinto. The first contact member 9 comprises a base portion laterally extending over an inner surface of the bottom wall of the box-shaped mold 11 and a head portion 9*b* laterally extending under an inner surface of the top wall of the box-shaped mold 11. The base portion and the head portion 9*b* are connected via a vertically extending portion and both extend in parallel to each other. The head portion 9*b* has a top portion which has a convex portion 9*a* extending downwardly for holding the flat cable 10. The first contact 9 also has a lead terminal portion 9*c* which is provided at an opposite side to the base portion. The first contact 9 is electrically connected via the lead terminal portion 9*c* to pads of the printed circuit board. The second contact 12 also has a base portion laterally extending over the bottom wall of the mold 1 and a head portion 12*b* laterally extending under an inner surface of the top wall of the mold 11. The base portion and the head portion 12*b* are connected via a vertically extending portion. The head portion 12*b* has a top which is provided with an convex 12*a* extending downwardly for securing the flat cable 10. As can be understood from FIG. 3 that the first contacts 9 arc aligned at the first side of the mold 11 at a predetermined constant pitch and the second contacts 12 are also aligned at the second side of the mold 11 at a predetermined constant pitch but the first and second contacts 9 and 12 aligned to alternate with each other so as to be isolated from each other.

It is required to isolate the first and second contacts 9 and 12 from each other. This limits the scaling down of the connector 8 and bars for improvement in he high density packaging on the printed circuit board.

In the above circumstances, it had been required to develop a novel connector for a flat cable, which is substantially scaled down and suitable for high density packaging on printed circuit broads.

SUMMARY OF THE INVENTION

Accordingly, it is an object of the present invention to provide a novel connector for a flat cable, which is free from any problems or disadvantages as described above.

It is a further object of the present invention to provide a novel connector for a flat cable, which is substantially scaled down.

It is a still further object of the present invention to provide a novel connector for a flat cable, which is suitable for a high density packaging on printed circuit broads.

The above and other objects, features and advantages of the present invention will be apparent from the following descriptions.

The present invention provides a connector for a flat cable comprising the following elements. A housing is provided, which comprises a rectangular-shaped base portion defined by first and second sides opposite to each other and parallel to a first lateral direction and third and fourth sides opposite to each other and parallel to a second lateral direction which is vertical to the first lateral direction, and first and second side walls provided on the third and fourth sides. A plurality of first contacts are provided, each of which has a first contact convex and a first lead terminal. The first contacts laterally extend from the first side toward the second side in the second direction. The first lead terminals project from the first side outwardly in the second direction. The first contact convex portions are provided at inner and top end portions of the first contacts. The first contact convex portions face upwardly. The first contacts are discontinuously aligned at a first pitch to form a first line in parallel to the first direction. A plurality of second contacts are provided, each of which has a second contact convex and a second lead terminal. The second contacts laterally extend from the second side toward the first side in the second direction. The second lead terminals project from the second side outwardly in the second direction. The second contact convex portions are provided at inner and top end portions of the second contacts. The second contact convex portions face upwardly. The second contacts are discontinuously aligned at a second pitch to form a second line in parallel to the first line. The second line is distanced from the first line in the second direction. Each of the second contact convex portions are positioned to correspond to an intermediate position between adjacent two of the first contact convex portions in the first direction so that the first and second contact convex portions are positioned to alternate to each other in the first direction. A lever is further pivotally provided to the side walls of the housing. The lever has an engaging portion which is spaced over the first and second contact convex portions for sandwiching a flat cable between the engaging portion and the first and second contact convex portions.

The above arrangement of the first and second contact convex portions of the first and second contacts substantially shortens the pitch of the contact points of the flat cable into a half in the first direction even the adjacent two of said first and second contact convex portions are distanced from each other by at least a minimum distance necessary for isolation between them. This provides a reduction in size of nearly one half along the first direction of the connector while the necessary isolation is ensured for the adjacent first and second contacts, resulting in a substantial reduction in size of the connector.

BRIEF DESCRIPTIONS OF THE DRAWINGS

Preferred embodiments of the present invention will be described in detail with reference to the accompanying drawings.

DISCLOSURE OF THE INVENTION

Figure 1:
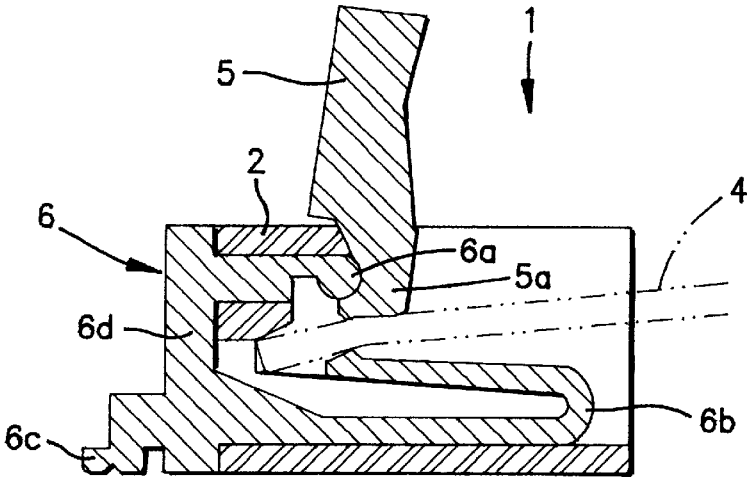
FIG. 1 PRIOR ART
FIG. 1 is a cross sectional elevation view illustrative of a conventional connector for a flat cable.
Figure 2:
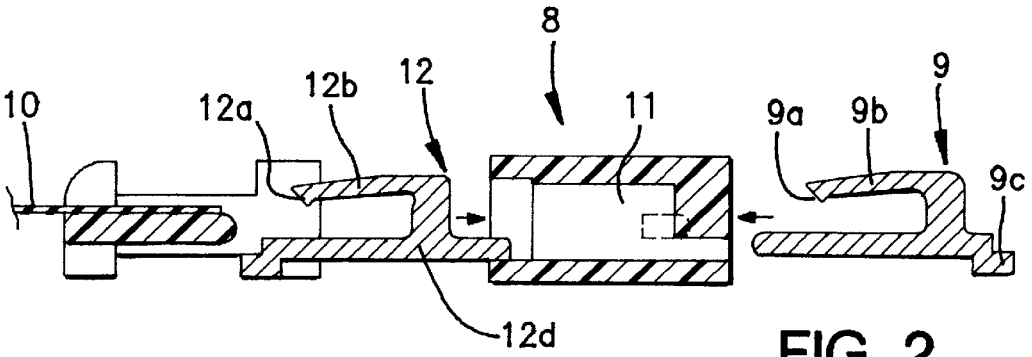
FIG. 2 PRIOR ART
FIG. 2 is a decomposed cross sectional view illustrative of the conventional connector.
Figure 3:
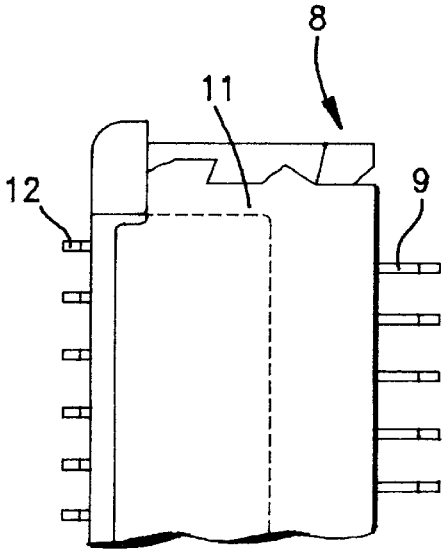
FIG. 3 PRIOR ART
FIG. 3 is a plane view illustrative of the conventional connector.
Figure 4:
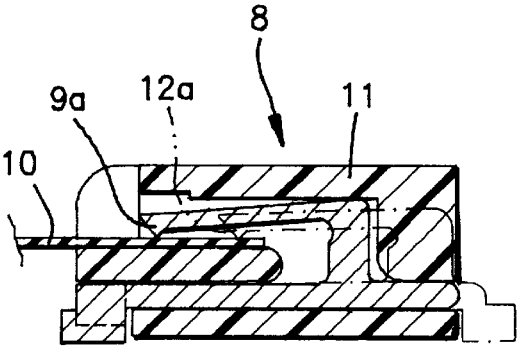
FIG. 4 PRIOR ART
FIG. 4 is a cross sectional view illustrative of the conventional connector.

The present invention provides a connector for a flat cable comprising the following elements. A housing is provided, which comprises a rectangular-shaped base portion defined by first and second sides opposite to each other and parallel to a first lateral direction and third and fourth sides opposite to each other and parallel to a second lateral direction which is vertical to the first lateral direction, and first and second side walls provided on the third and fourth sides. A plurality of first contacts are provided, each of which has a first contact convex and a first lead terminal. The first contacts laterally extend from the first side toward the second side in the second direction. The first lead terminals project from the first side outwardly in the second direction. The first contact convex portions are provided at inner and top end portions of the first contacts. The first contact convex portions face upwardly. The first contacts are discontinuously aligned at a first pitch to form a first line in parallel to the first direction. A plurality of second contacts are provided, each of which has a second contact convex and a second lead terminal. The second contacts laterally extend from the second side toward the first side in the second direction. The second lead terminals project from the second side outwardly in the second direction. The second contact convex portions are provided at inner and top end portions of the second contacts. The second contact convex portions face upwardly. The second contacts are discontinuously aligned at a second pitch to form a second line in parallel to the first line. The second line is distanced from the first line in the second direction. Each of the second contact convex portions are positioned to correspond to an intermediate position between adjacent two of the first contact convex portions in the first direction so that the first and second contact convex portions are positioned to alternate to each other in the first direction. A lever is further pivotally provided to the side walls of the housing. The lever has an engaging portion which is spaced over the first and second contact convex portions for sandwiching a flat cable between the engaging portion and the first and second contact convex portions.

The above arrangement of the first and second contact convex portions of the first and second contacts substantially shortens the pitch of the contact points of the flat cable into a half in the first direction while the adjacent two of said first and second contact convex portions are distanced from each other by at least a minimum distance necessary for isolation between them. This provides a reduction in size of newly one half along the first direction of the connector even the necessary isolation is ensured for the adjacent first and second contacts, resulting in a substantial reduction in size of the connector.

It is preferable that the engaging portion of the lever comprises a curved engaging end portion and a flat engaging portion adjacent to the curved engaging end portion so that if the lever stands vertically or is oblique, then the curved engaging end portion is made into contact with the flat cable, and if the lever lies down, then the flat engaging portion is made into contact with the flat cable.

In the above case, it is more preferable that the curved engaging end portion has variations in thickness to have a maximum value at a critical position relatively near a boundary between the curved engaging end portion and the flat engaging portion so that if the lever is made into contact with the flat cable at the critical position, then a contact force between the lever and the flat cable becomes maximum.

It is advantageous to further provide a plurality of first slits laterally extending from the first side toward the second side in the second direction and a plurality of second slits laterally extend from the second side toward the first side in the second direction. The first slits have a width slightly larger than a width of the first contacts for receiving the first contacts except for the first lead terminals. The first contact convex portions project over the first slits. The first slits are discontinuously aligned at the first pitch in parallel to the first direction. The second slits have a width slightly larger than a width of the second contacts for receiving the second contacts except for the second lead terminals. The second contact convex portions project over the second slits. The second slits are discontinuously aligned at the second pitch in parallel to the first direction. The second slits are distanced from the first slits in the second direction. Each of the second slits is positioned to correspond to an intermediate position between adjacent two of the first slits in the first direction so that the first and second slits are positioned to alternate to each other in the first direction.

In the above case, it is more advantageous that a body of the first contact comprises a head portion laterally extending toward an inside of the first slit, and a base portion laterally extending toward the inside of the first slit but being shorter than the head portion. The head and base portions are formed from a single piece.

In the above case, also it is more advantageous that a body of the second contact comprises a contact arm portion laterally extending toward an inside of the second slit, a base portion laterally extending toward the inside of the second slit but being longer than the contact arm portion, the contact arm and base portions being unitary formed, and a spring supporting portion laterally extending in the same direction as the contact arm portion and the base portion. The spring supporting portion is positioned over the contact arm portion and extends to beyond an end of the contact arm portion. The end portion of the spring supporting portion is generally cylinder-shaped. The spring supporting portion further has a recessed portion positioned on a bottom side thereof and just inside the generally cylinder-shaped end portion thereof. The spring supporting portion is formed via a vertically extending portion to the contact arm portion and the base portion, so that the spring supporting portion is positioned over the flat cable whilst the contact arm portion is positioned under the flat cable if the flat cable is inserted into the connector.

In the above case, it is more preferable that the base portion of the second contact has the same bottom level as the rectangular-shaped base portion of the housing so that if the connector is mounted on a printed circuit board, then the base portion of the second contact is securely in contact with and supported by the printed circuit board so that when the lever rotates around the generally cylinder-shaped end portion of the spring supporting portion of the second contact, a rotation stress appears on the spring supporting portion of the second contact. This rotation stress is, however, absorbed by the base portion of the second contact having the same bottom level as the housing since the base portion is securely supported by the printed circuit board on which this connector is mounted. On the other hand, the first contact is free from any rotation stress caused by the operation of the lever. The above structure allows an absorption of the rotation stress via the base portion of the second contact and further allows the first contact to be free from any stress, for which reason no stress appears on the first and second lead terminal portions of the first and second contacts. This causes no clucking on the first and second lead terminal portions which are connected to the pads on the printed circuit board. This allows a stable connection of the connector to the printed circuit board.

In the above case, it is further preferable that the generally cylinder-shaped end portion of the spring supporting portion of the second contact is positioned over an intermediate point between the first and second contact convex portions of the first and second contacts so that the generally cylinder-shaped end portion and the contact convex portions form a generally isosceles triangle.

It is also preferable that opposite side walls of the lever are provided with convex portions, whilst inside faces of the side walls of the housing are provided with concave portions which are to be engaged with the convex portions when the lever becomes lie down.

PREFERRED EMBODIMENT

A preferred embodiment according to the present invention will be described, wherein a novel connector for a flat cable is provided, which is scaled down and suitable for a high density packaging.

Figure 5:
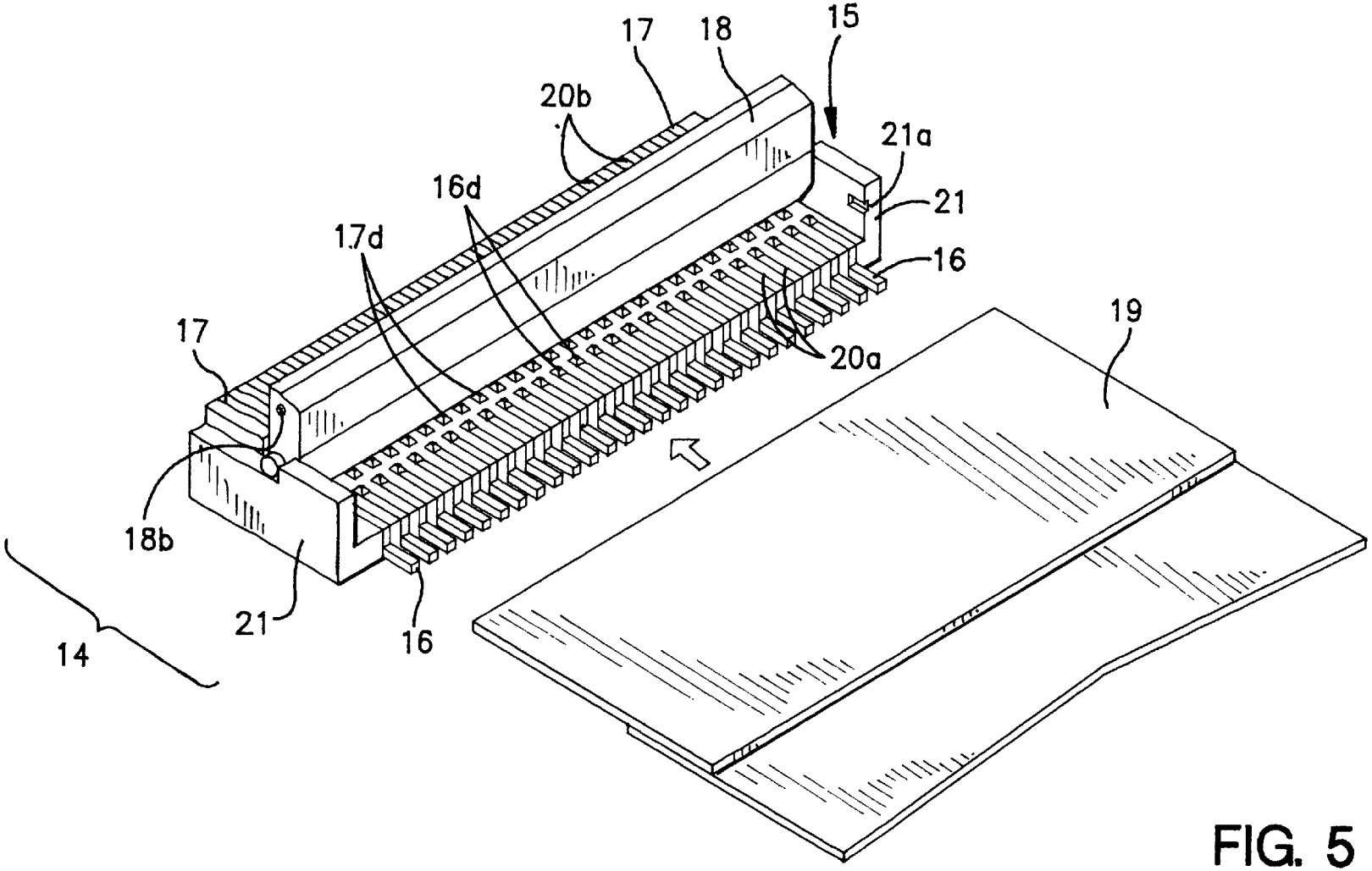
FIG. 5 is a schematic view illustrative of a novel connector for a flat cable in a preferred embodiment according to the present invention.

FIG. 5 is a schematic view illustrative of a novel connector for a flat cable in a preferred embodiment according to the present invention. A connector 14 is designed for a flat cable 19. The connector 14 comprises a housing 15 having first and second sides, a set of first contacts 16 engaged into the first side of the housing 15, a set of second contacts 17 engaged into the second side of the housing 15, and a lever 18 provided on the housing 15 for holding the flat cable 19. The housing 15 has opposite side walls 21 vertically extending to define a flat cable receiving area which correspond to a width of the flat cable 19. The lever 18 has substantially the same width as that of the flat cable receiving area. In FIG. 5, the lever 18 is opened. The housing 15 has the first side through which the flat cable 19 is inserted into the flat cable receiving area of the housing 15.

Figure 6A:
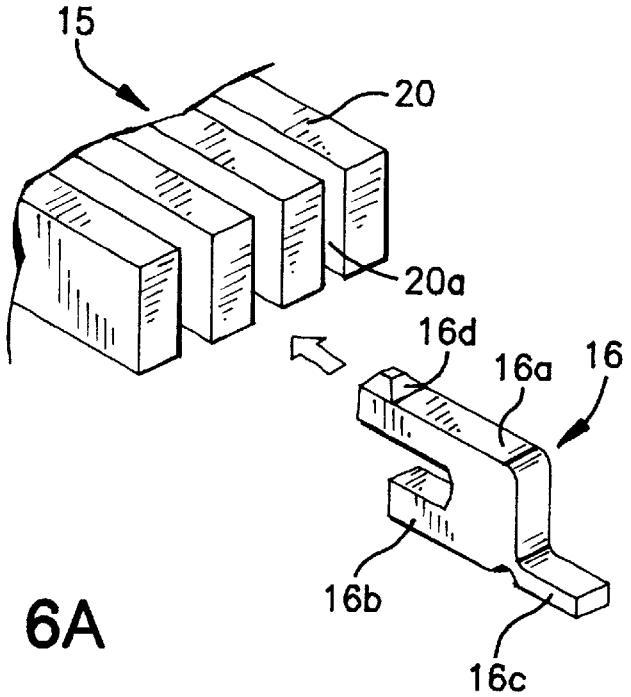
FIG. 6A is a partially enlarged view illustrative of one of first contacts of a novel connector for a flat cable in a preferred embodiment according to the present invention.

The first side of the housing 15 is formed with a set of first slits 20*a* aligned at a predetermined constant interval, wherein the first slits 20*a* extend from the first side thereof toward inside thereof in parallel to each other. The first contacts 16 are provided to fit into the first slits 20*a* except for lead terminal portions thereof which project from the first side of the housing 15 for providing electrical contacts with pads on a printed circuit board. FIG. 6A is a partially enlarged view illustrative of one of the first contacts 16 and the first slits 20*a*. The each slit 20*a* has a width just wider than a width of the first contact 16. The each first contact 16 comprises a head portion 16*a* laterally extending toward an inside of the first slit 20*a* and a base portion 16*b* laterally extending toward the inside of the first slit 20*a* but being shorter than the head portion 16*a*. The head and base portions are unitary formed. The each first contact 16 further has a lead terminal portion 16*c* which laterally extends but in an opposite direction to the base and head portions 16*b* and 16*a* so that the head and base portions 16*a* and 16*b* fit into the first slit 20*a* whilst the lead terminal portion 16*c* projects from the first slit 20*a*. The each first contact 16 further has a contact point 16*d* which is provided on an end portion of the head portion 16*a* so that the first contact is in contact via the contact point 16*d* to the bottom plane of the flat cable when the flat cable is inserted into the connector 14. The bottom level of the first contact 16 is the same as the bottom level of the first slit 20*a* or the bottom level of the housing 15.

Figure 6B:
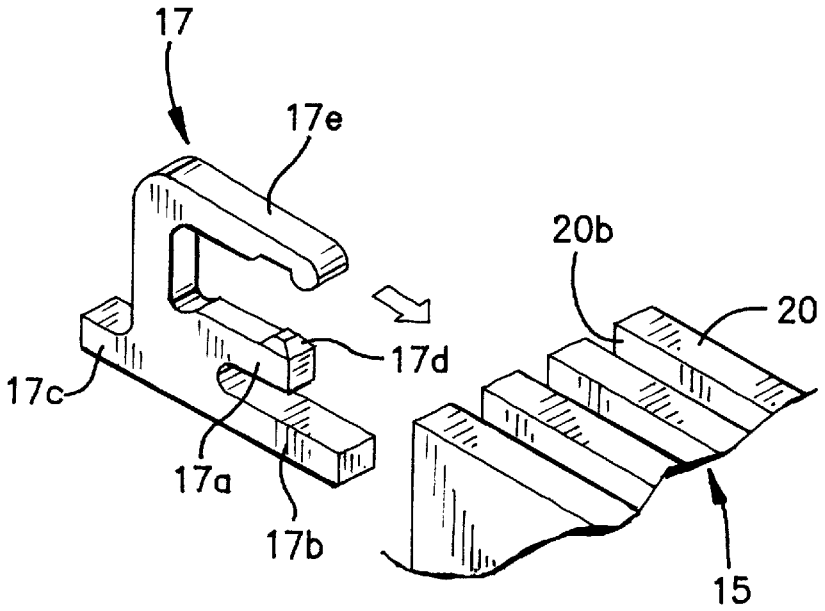
FIG. 6B is a partially enlarged view illustrative of one of second contacts of a novel connector for a flat cable in a preferred embodiment according to the present invention.

The second side of the housing 15 is formed with a set of second slits 20*b* aligned at a predetermined constant interval, wherein the second slits 20*b* extend from the second side thereof toward inside thereof in parallel to each other. The second contacts 17 are provided to fit into the second slits 20*b* except for lead terminal portions thereof which project from the second side of the housing 15 for providing electrical contacts with pads on the printed circuit board. FIG. 6B is a partially enlarged view illustrative of one of the second contacts 17 and the second slits 20*b*. The each slit 20*b* has a width just wider than a width of the second contact 17. The each second contact 17 comprises a contact arm portion 17*a* laterally extending toward an inside of the second slit 20*b* and a base portion 17*b* laterally extending toward the inside of the second slit 20*b* but being longer than the contact arm portion 17*a*. The contact arm and base portions are formed from a single piece. The each second contact 17 further has a lead terminal portion 17*c* which laterally extends but in an opposite direction to the base and contact arm portions 17*b* and 17*a* so that the contact arm and base portions 17*a* and 17*b* fit into the second slit 20*b* whilst the lead terminal portion 17*c* projects from the second slit 20*b*. The each second contact 17 further has a contact point 17*d* which is provided on an end portion of the contact arm portion 17*a* so that the second contact is in contact via the contact point 17*d* to the bottom plane of the flat cable when the flat cable is inserted into the connector 14. The each second contact 17 further more has a spring supporting portion 17*e* laterally extending in the same direction as the contact arm portion 17*a* and the base portion 17*b*. The spring supporting portion 17*e* is positioned over the contact arm portion 17*a* and extends to beyond the end portion of the contact arm portion 17*a*. The end portion of the spring supporting portion 17*e* is generally cylinder-shaped. The spring supporting portion 17*e* has a recessed portion positioned on a bottom side thereof and just inside the generally cylinder-shaped end portion thereof The spring supporting portion 17*e* is formed via a vertically extending portion to the contact arm portion 17*a* and the base portion 17*b*. The spring supporting portion 17*e* is positioned over the flat cable 19 whilst the contact arm portion 17*a* is positioned under the flat cable 19 if the flat cable 19 is inserted into the connector 14. The second side of the housing 15 is thicker than the first side thereof so that if the second contact 17 fits into the second slit 20*b*, then not only the contact arm portion 17*a* and the base portion 17*b* but also the spring supporting portion 17*e* fit into the second slit 20*b*, even the lead terminal portion 17*c* is positioned outside the second slit 20*b* as described above. The bottom level of the second contact 17 is the same as the bottom level of the second slit 20*b* or the bottom level of the housing 15.

With reference back to FIG. 5, even the first and second slits 20*a* and 20*b* extend from the first and second sides of the housing 15 toward the inside thereof, both the contact points 16*d* and 17*d* of the first and second slits 20*a* and 20*b* do not cross to each other and are spaced from each other in the direction along which the first and second slits 20*a* and 20*b* extend as well illustrated in FIG. 5. Further, in the direction parallel to the first and second sides of the housing 15 and vertical to the direction along which the first and second slits 20*a* and 20*b* extend, the first and second slits 20*a* and 20*b* are provided to alternate to each other. The distance between the adjacent first slits 20*a* is almost the same as the width of the second slit 20*b*. The distance between the adjacent second slits 20*b* is almost the same as the width of the first slit 20*a*. As a result, the contact points 16*d* of the first contacts 16 are aligned on a first straight line in parallel to the first and second sides of the housing 15, whilst the contact points 17*d* of the second contacts 17 are aligned on a second straight line in parallel to the first straight line but separated therefrom by a distance which is nearly equal to the size of the contact points 16*d* and 17*d* of the first and second contacts 16 and 17. The contact points 16*d* and 17*d* of the first and second contacts 16 and 17 are arranged on the first and second lines but to alternate to each other in the direction along the first and second lines as well illustrated in FIG. 5. The above arrangement of the contact points 16*d* and 17*d* of the first and second contacts 16 and 17 shortens the pitch of the contact points 16*d* and 17*d* by half in the direction along the first and second sides of the housing 15 even the adjacent contact points 16*d* and 17*d* are distanced from each other by a minimum distance necessary for isolation between them in the oblique direction to the first and second sides of the housing 15. This provides a nearly half reduction of the width of the connector 14 even the necessary isolation is ensured for the adjacent contact points 16*d* and 17*d* whereby resulting in a substantial reduction in size of the connector 14.

Figure 7A:
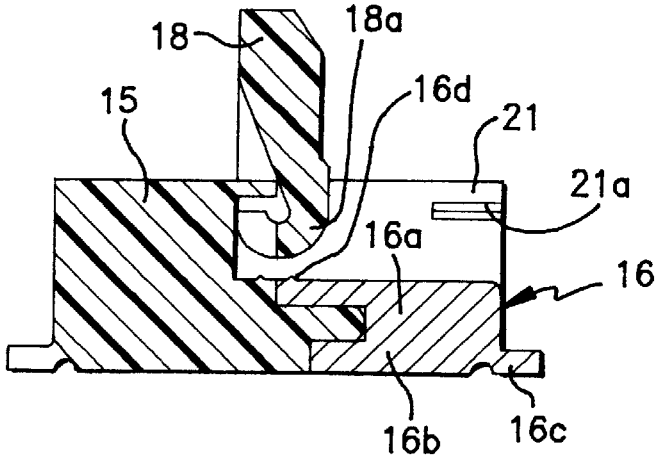
FIG. 7A is a cross sectional elevation view illustrative of a first contact engaged in a novel connector for a flat cable when a lever is opened in a preferred embodiment according to the present invention.
Figure 7B:
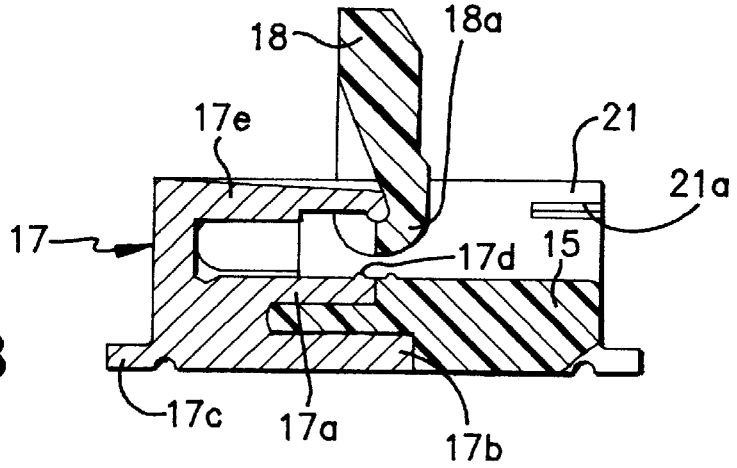
FIG. 7B is a cross sectional elevation view illustrative of a second contact engaged in a novel connector for a flat cable when a lever is opened in a preferred embodiment according to the present invention.
Figure 7C:
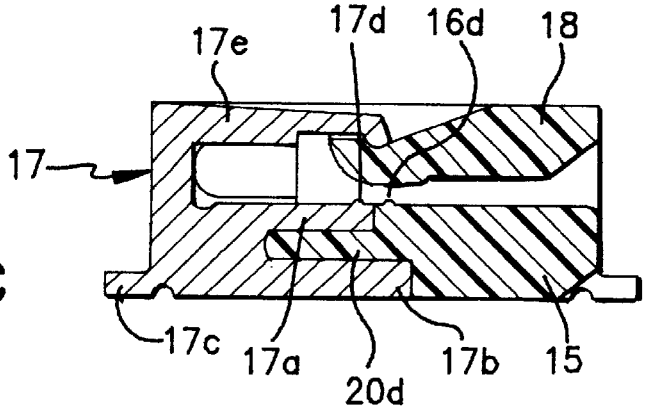
FIG. 7C is a cross sectional elevation view illustrative of a second contact engaged in a novel connector for a flat cable when a lever is closed in a preferred embodiment according to the present invention.

As illustrated in FIGS. 7B and 7C, the generally cylinder-shaped end portion of the spring supporting portion 17*e* of the second contact 17 is positioned over an intermediate point between the contact points 16*d* and 17*d* of the first and second contacts so that the generally cylinder-shaped end portion and the contact points 16*d* and 17*d* form an isosceles triangle.

The lever 18 is pivotally provided on the housing 15. The lever 18 has a curved engaging portion 18*a* which is engaged with the generally cylinder-shaped end portion of the spring supporting portion 17*e* of the second contact 17 as illustrated in FIG. 7B so that the lever 18 may pivot around the generally cylinder-shaped end portion of the spring supporting portion 17*e*. The lever 18 stands vertically as illustrated in FIGS. 5, 6A and 6B before the flat cable 19 is inserted into the flat cable receiving area of the connector 14. Thereafter, the lever 18 is made down by pivotal motion of the lever 18 around the generally cylinder-shaped end portion of the spring supporting portion 17*e* of the second contact 17 whereby the flat cable 19 is securely sandwiched between the lever 18 and the contact points 16*d* and 17*d* of the first and second contacts 16 and 17.

Figure 8:
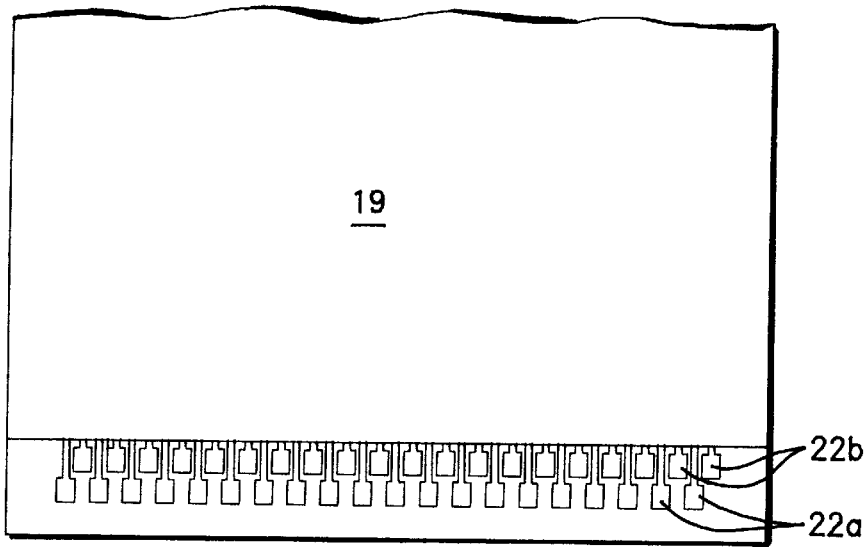
FIG. 8 is a bottom plane view illustrative of a bottom surface of a flat cable for which a novel connector is designed in a preferred embodiment according to the present invention.

FIG. 8 is illustrative of a bottom surface of the flat cable 19. First contact pads 22*a* and second contact pads 22*b* are provided on a head region in the bottom surface of the flat cable. The first contact pads 22*a* and second contact pads 22*b* are arranged to form first and second parallel lines respectively in parallel to the first and second sides of the housing 15. The first contact pads 22*a* and second contact pads 22*b* are aligned to alternate to each other in the direction along a head edge of the flat cable 19. The first contact pads 22*a* and second contact pads 22*b* are thus positioned to correspond to the contact points 17*d* and 16*d* of the second and first contacts 17 and 16 respectively. Accordingly, when the flat cable 19 is inserted into the connector 14 and the lever 18 is made down to hold the flat cable 19, then the contact points 17*d* and 16*d* of the second and first contacts 17 and 16 are electrically and physically made into contact with the first and second contact pads 22*a* and 22*b* of the flat cable 19 respectively. When the lever 18 is made down and closed, the lever 18 may act as a cap of the housing 15 for covering the flat cable 19. When the lever 18 is opened, which vertically stands, the end of the curved engaging portion 18*a* of the lever 18 is made into contact with the flat cable 19. When the lever 18 is half-opened and becomes oblique, an intermediate point of the curved engaging portion 18*a* of the lever 18 is made into contact with the flat cable 19. When the lever 18 is closed and becomes lie down, a flat engaging portion adjacent to the curved engaging portion 18*a* of the lever 18 is made into contact with the flat cable 19. The above structure shortens the effective pitch of the contact pads 22*a* and 22*b* into half. This further reduces the width of the flat cable 19.

Further, as illustrated in FIG. 5, the opposite side walls of the lever 18 are provided with convex portions 18*b*, whilst inside faces of the side walls of the housing 15 are provided with concave portions 21*a* which are to be engaged with the convex portions 18*b* when the lever 18 is closed and becomes lie down to hold the lever 18 in closing state.

The above arrangement of the contact points 16*d* and 17*d* of the first and second contacts 16 and 17 shortens the pitch of the contact points 16*d* and 17*d* into a half in the direction along the first and second sides of the housing 15 even the adjacent contact points 16*d* and 17*d* are distanced from each other by a minimum distance necessary for isolation between them in the oblique direction to the first and second sides of the housing 15. This provides a nearly half reduction of the width of the connector 14 even the necessary isolation is ensured for the adjacent contact points 16*d* and 17*d* whereby resulting in a substantial reduction in size of the connector 14. The above structure also shortens the effective pitch of the contact pads 22*a* and 22*b* into half. This further reduces the width of the flat cable 19. Those allow a high density packaging of the connector for the flat cable.

Further, when the lever 18 rotates around the generally cylinder-shaped end portion of the spring supporting portion 17*e* of the second contact 17, a rotation stress appears on the spring supporting portion 17*e* of the second contact 17. This rotation stress is absorbed by the base portion 17*b* of the second contact 17 having the same bottom level as the bottom level of the housing 15 since the base portion 17*b* is securely supported by the printed circuit board on which this connector 14 is mounted. On the other hand, the first contact 16 is free from any rotation stress caused by the operation of the lever 18. The above structure allows an absorption of the rotation stress via the base portion 17*b* of the second contact 17 and further allows the first contact 16 free from any stress, for which reason no stress appears on the lead terminal portions 16*c* and 17*c* of the first and second contacts 16 and 17. This causes no clucking on the lead terminal portions 16*c* and 17*c* which are connected to the pads on the printed circuit board. This allows a stable connection of the connector 14 to the printed circuit board.

Furthermore, the curved engaging portion 18*a* of the lever 18 allows a smooth rotary motion of the lever 18 around the generally cylinder-shaped end portion of the spring supporting portion 17*e* of the second contact 17 and further provides a secure holding of the flat cable 19.

Figure 9A:
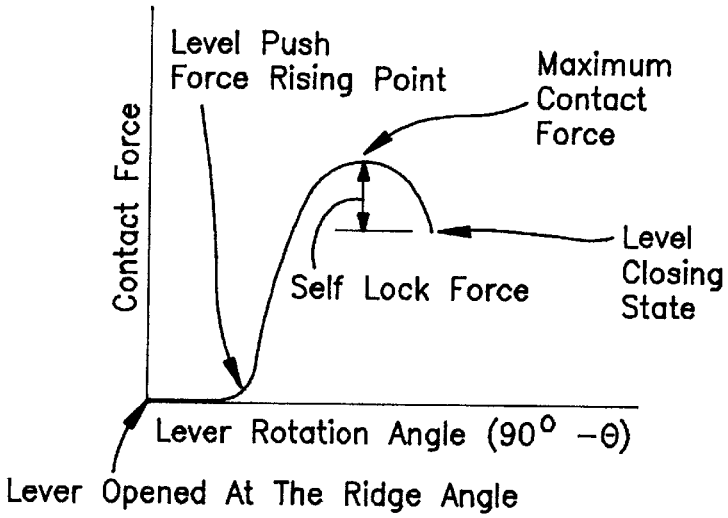
FIGS. 9A–9C are view illustrative of variations contact force of a connector to a flat cable versus various angles of lever.
Figure 9B:
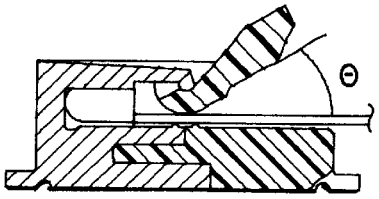
Figure 9C:
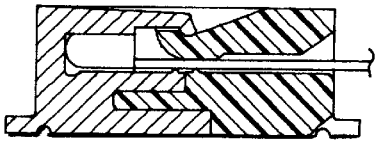

FIG. 9A is illustrative of variations in contact force of the lever 18 with the flat cable 19 versus the rotation angle of the lever 18. When the lever 18 stands vertically, the contact force of the lever 18 with the flat cable is almost zero. As the lever 18 is made oblique, then the curved engaging portion 18*a* of the lever 18 is made into contact with and pushes the flat cable 19 whereby the contact force of the lever 18 with the flat cable is rapidly increased from zero so that when the curved engaging portion 18*a* in the vicinity of the flat engaging portion is in contact with the flat cable 19 (FIG. 9B), the contact force has a maximum value. As the lever 18 is made lie down and the flat engaging portion of the lever 18 is in contact with the flat cable 19, then the contact force is reduced from the maximum value as well illustrated in FIG. 9C. When the lever 18 is closed and the flat engaging portion of the lever 18 is in contact with the flat cable 19, the contact force is lower than the maximum value by a self lock force which locks the lever once made lie down. If the lever 18 once made lie down is risen up, it is required to apply the lever 18 with a force larger than the self lock force. In addition, the lever 18 has the opposite sides which are provided with the convex portions 18*b* to be engaged with the concave portions 21*a* formed on the inner sides of the side walls of the housing 15 only when the lever 18 is made lie down. This structure provides a further self lock of the lever 18.

The following structural modification to the above embodiment may be possible. Even in the above embodiment, the first and second contacts 16 and 17 are inserted into the first and second slits 20*a* and 20*b*, in the modification it is possible that no slit is provided but the first and second contacts 16 and 17 are shaped to sandwich the base of the housing 15 between the head portions 16*a* or the contact arm portion 17*a* and the base portion 16*b* or 17*b*.

Even in the above embodiment the lever 18 is supported only by the second contacts 17, it is further possible as a modification that the lever 18 is supported by not only the second contact but also the first contact modified to be engaged with the lever 18.

Whereas modifications of the present invention will be apparent o a person having ordinary skill in the art, to which the invention pertains, it is to be understood that embodiments as shown and described by way of illustrations are by no means intended to be considered in a limiting sense. Accordingly, it is to be intended to cover by claims any modifications of the present invention which fall within the spirit and scope of the present invention.

What is claimed is:

1. A connector for a flat cable comprising:

a housing comprising a rectangular-shaped base portion defined by first and second sides opposite to each other and third and fourth sides opposite to each other, and first and second side walls provided on said third and fourth sides;

a plurality of first contacts, each of which has a first contact convex and a first lead terminal, said first contacts laterally extending from said first side toward said second side, said first lead terminals projecting from said first side outwardly, said first contact convex portions being provided at inner and top end portions of said first contacts, said first contact convex portions face upwardly, said first contacts being aligned at a first pitch to form a first line parallel to said first and second sides;

a plurality of second contacts, each of which has a second contact convex and a second lead terminal, said second contacts laterally extending from said second side toward said first side, said second lead terminals projecting from said second side outwardly, said second contact convex portions being provided at inner and top end portions of said second contacts, said second contact convex portions face upwardly, said second contacts being aligned at a second pitch to form a second line parallel to said first line, said second line being adjacent to said first line, and each of said second contact convex portions being positioned along said second line to correspond to an intermediate position between adjacent two of said first contact convex portions along said first line so that said first and second contact convex portions alternate with one another; and a lever being pivotally provided to said side walls of said housing, said lever having an engaging portion which is spaced over said first and second contact convex portions for sandwiching a flat cable between said engaging portion and said first and second contact convex portions.

2. The connector as claimed in claim 1, wherein opposite side walls of said lever are provided with convex portions, whilst inside faces of said side walls of the housing are provided with concave portions which are to be engaged with said convex portions when said lever lies down.

3. The connector as claimed in claim 1, wherein said engaging portion of said lever comprises a curved engaging end portion and a flat engaging portion adjacent to said curved engaging end portion so that if said lever stands vertically or is oblique, then said curved engaging end portion is made into contact with said flat cable, and if said lever lies down, then said flat engaging portion is made into contact with said flat cable.

4. The connector as claimed in claim 3, wherein said curved engaging end portion has variations in thickness to have a maximum value at a critical position relatively near a boundary between said curved engaging end portion and said flat engaging portion so that if said lever is made into contact with said flat cable at said critical position, then a contact force between said lever and said flat cable becomes maximum.

5. The connector as claimed in claim 1, further comprising:

a plurality of first slits laterally extending from said first side toward said second side, said first slits having a width slightly larger than a width of said first contacts for receiving said first contacts except for said first lead terminals, said first contact convex portions projecting over said first slits, said first slits being aligned at said first pitch parallel to said first line; and a plurality of second slits laterally extending from said second side toward said first side, said second slits having a width slightly larger than a width of said second contacts for receiving said second contacts except for said second lead terminals, said second contact convex portions projecting over said second slits, said second slits being aligned at said second pitch in parallel to said first line, said second slits being adjacent to said first slits as viewed from said first and second sides, and each of said second slits being positioned to correspond to an intermediate position between adjacent two of said first slits along said first line so that said first and second slits alternate with one another.

6. The connector as claimed in claim 5, wherein a body of said first contact comprises:

a head portion laterally extending toward an inside of said first slit; and a base portion laterally extending toward said inside of said first slit but being shorter than said head portion, said head and base portions being unitary formed.

7. The connector as claimed in claim 5, wherein a body of said second contact comprises:

a contact arm portion laterally extending toward an inside of the second slit;

a base portion laterally extending toward said inside of said second slit but being longer than said contact arm portion, said contact arm and base portions being unitary formed; and a spring supporting portion laterally extending in the same direction as said contact arm portion and said base portion, said spring supporting portion being positioned over said contact arm portion and extending to beyond an end of the contact arm portion, said end portion of said spring supporting portion being generally cylinder-shaped, said spring supporting portion further having a recessed portion positioned on a bottom side thereof and just inside said generally cylinder-shaped end portion thereof, said spring supporting portion being unitary formed via a vertically extending portion to said contact arm portion and said base portion, so that said spring supporting portion is positioned over said flat cable whilst said contact arm portion is positioned under said flat cable if said flat cable is inserted into said connector.

8. The connector as claimed in claim 7, wherein said base portion of said second contact has the same bottom level as said rectangular-shaped base portion of said housing.

9. The connector as claimed in claim 7, wherein said generally cylinder-shaped end portion of said spring supporting portion of said second contact is positioned over an intermediate point between said first and second contact convex portions of said first and second contacts so that said generally cylinder-shaped end portion and said contact convex portions form a generally isosceles triangle.

* * * * *